United States Patent [19]

Takeuchi et al.

[11] Patent Number: 4,865,913

[45] Date of Patent: Sep. 12, 1989

[54] THERMAL TRANSFER INK SHEET

[75] Inventors: Hikaru Takeuchi, Zushi; Masato Yoshida, Kasukabe; Shiro Nemoto, Tokyo, all of Japan

[73] Assignee: Toppan Printing Co., Ltd., Tokyo, Japan

[21] Appl. No.: 167,020

[22] Filed: Mar. 11, 1988

[30] Foreign Application Priority Data

Mar. 13, 1987 [JP] Japan ..... 62-58327

[51] Int. Cl.[4] ..... B41M 5/26

[52] U.S. Cl. ..... 428/321.3; 428/195; 428/212; 428/336; 428/341; 428/342; 428/488.4; 428/913; 428/914

[58] Field of Search ..... 428/195, 321.3, 484, 428/488.1, 488.4, 913, 914, 212, 204, 206, 207, 304.4, 306.6, 307.7, 308.4, 317.1, 317.7, 318.4, 320.2, 321.1, 334, 336, 338, 339, 341, 342

[56] References Cited

U.S. PATENT DOCUMENTS 4,650,494 3/1987 Kutsukake ..... 428/195
4,652,486 3/1987 Tasaka et al. ..... 428/321.3

FOREIGN PATENT DOCUMENTS 2130880 6/1987 Japan ..... 428/913

*Primary Examiner*—Ellis P. Robinson
*Assistant Examiner*—P. R. Schwartz
*Attorney, Agent, or Firm*—Bacon & Thomas

[57] ABSTRACT

A thermal transfer ink sheet adopted to be repeatedly reused several times in a printing operation by means of a thermal printer. The thermal transfer ink sheet comprises a sheet-like base such as paper or a plastic film, a hot-melt ink layer stacked on the base with an adhesive layer disposed therebetween, and an ink-holding porous membrane layer filled with hot-melt ink and stacked on the ink layer. Another hot-melt ink layer may be further stacked on the ink-holding porous membrane layer.

13 Claims, 3 Drawing Sheets

THERMAL TRANSFER INK SHEET

BACKGROUND OF THE INVENTION

1. Field of the Invention

The present invention relates to a thermal transfer ink sheet used for a thermal printer or a thermal typewriter and, more particularly, to a thermal transfer ink sheet which can be re-used a number of times.

2. Description of the Related Art

A conventional thermal transfer sheet has a simple structure wherein a hot-melt ink layer consisting of a hot-melt binder and a coloring agent is formed on a base film. Therefore, the conventional thermal transfer sheet has the following drawbacks. More specifically, a conventional thermal transfer sheet is a so-called one-time type thermal transfer sheet. In other words, almost no ink layer of a recording medium can be left on a base film upon a single transfer operation, and only a print with density variations can be obtained in a second use and thereafter. Therefore, cost for obtaining a printed record is increased. Since print marks are clearly left on the thermal transfer sheet by only a single printing operation, this poses a problem of confidentiality. Under these circumstances, studies on a reusable thermal transfer sheet have been made.

In a conventional reusable thermal transfer sheet, a thermal transfer material is proposed wherein a heat-resistant resin layer having a microporous film net-like structure is provided on a base film, and hot-melt ink is contained in the pores of the resin layer (Japanese Patent Disclosure (Kokai) No. 55-105579). The transfer material is receiving a lot of attention as a means for controlling a transfer amount of ink in accordance with application energy level of a heating body of a thermal head. However, a porosity is limited due to a required mechanical strength of the porous layer serving as an ink holding body, and hence, an amount of ink filled in pores is limited. For this reason, an ink sheet in which ink of the same volume as that of a porous body is held in the porous body becomes bulky as compared to an ink sheet which does not contain such a large amount of ink. This is disadvantageous in terms of thermal sensitivity. Even if a high-density transferred image is obtained upon application of high energy, an image with good printing quality cannot be obtained. Hot-melt ink heated by a thermal head is not perfectly transferred to a transfer body, thus preventing efficient utilization of ink.

In order to efficiently use ink, another thermal transfer sheet is proposed wherein a hot-melt ink layer is provided on a base film, and a porous film is provided on the ink layer (Japanese Patent Disclosure (Kokai) No. 60-135294). In this transfer sheet, since the thickness of the porous film is set to be smaller than that of the hot-melt ink layer, an amount of ink held and left in a porous body after the sheet is subjected to printing by a thermal head can be small, thus improving utilization efficiency of ink. However, since no ink is filled in advance in the porous body, unnecessary energy is wasted until ink passes through the film, resulting in poor thermal response. In this thermal transfer sheet, transfer media having different contraction stresses are stacked. Therefore, this multi-layered sheet tends to be curled, and travel interference during a printing operation easily occurs. In addition, since a bonding strength between an ink surface and the porous body is not sufficient, the porous body may be broken during the printing operation. In order to increase the number of repetitions, if an ink coating amount is increased, the ink layer is easily peeled from the sheet base. For this reason, the conventional reusable thermal transfer sheet cannot be put into practical use. In addition, a recording sheet is limited, and printing cannot be satisfactorily performed on a normal paper sheet having a surface roughness of 30 to 50 sec (Bekk smoothness).

SUMMARY OF THE INVENTION

The present invention has been made in consideration of the above situation and has as its object to improve prior art techniques of the above-mentioned thermal recording sheets, and to provide a thermal transfer ink sheet with which thermal sensitivity of a multiple reusable thermal transfer sheet is improved, and a high-quality image can be formed, and to provide a thermal transfer ink sheet with which properties associated with ink transfer efficiency and repetition life are improved, and printing can be performed on a normal paper sheet.

In order to achieve the above object, according to a first aspect of the present invention, there is provided a thermal transfer ink sheet comprising a sheet-like base, a hot-melt ink layer which is stacked on the base through an adhesive layer, and an ink holding (an open cell structure) layer, which is stacked on the ink layer and is filled with hot-melt ink.

In order to achieve the above object, according to a second aspect of the present invention, there is provided a thermal transfer ink sheet comprising a sheet-like base, a first hot-melt ink layer stacked on the base through an adhesive layer, an ink holding porous film layer which is stacked on the ink layer and is filled with hot-melt ink, and a second hot-melt ink layer stacked on the ink holding porous film layer.

When a thermal transfer ink sheet of the present invention is used, a recording sheet is arranged to face the upper surface of the thermal transfer ink sheet. Thereafter, the base-side surface of the thermal transfer ink sheet is locally heated by a thermal printing body which generates heat energy in correspondence with an arbitrary image signal so as to melt the hot-melt ink. The melted ink is forced out via through holes of the ink holding porous film layer, thus transferring an image onto the recording sheet.

DESCRIPTION OF THE PREFERRED EMBODIMENTS

For the best understanding of the present invention, a detailed description will be made with reference to the accompanying drawings.

Figure 1:
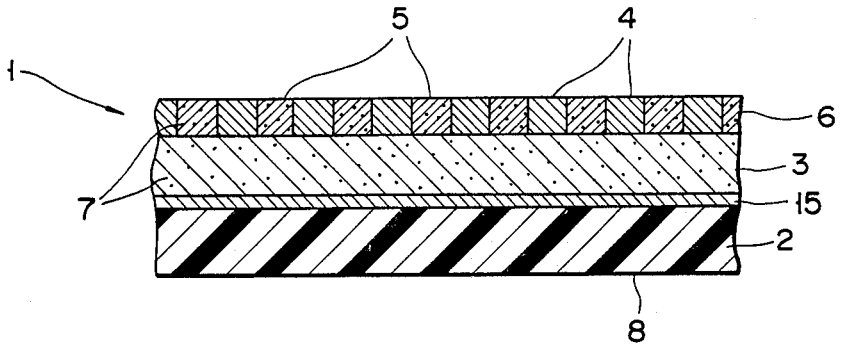
FIGS. 1 and 2 are sectional views of thermal transfer ink sheets according to the present invention.
Figure 2:
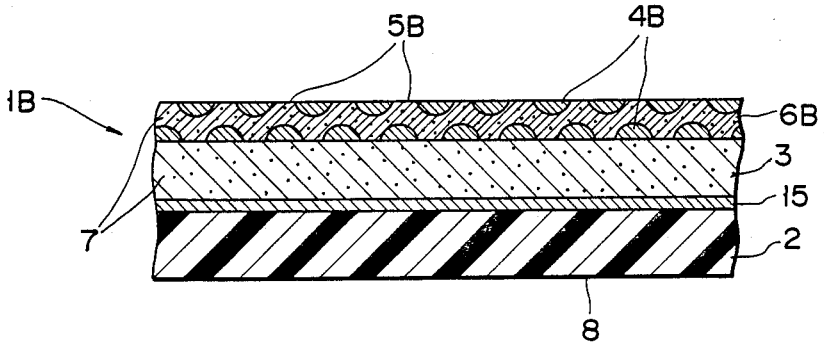

FIGS. 1 and 2 are schematic sectional views showing an embodiment of thermal transfer ink sheets which employ the present invention. Referring to FIGS. 1 and 2, each of thermal transfer ink sheets 1 and 1B comprises a multilayered structure of hot-melt ink layer 3 which is stacked on a base 2 through an adhesive layer 15 and contains coloring agent 7, and an ink holding porous membrane layer 6 (or 6B) prepared by filling a hot-melt ink 5 (or 5B) in porous membrane 4 (or 4B). Porous membrane 4 shown in FIG. 1 has independent holes which extend to hot-melt ink layer 3. Porous film 4B shown in FIG. 2 has continuous holes which extend to the hot-melt ink layer in a three-dimensional net-like form.

Base 2 is a dense, thin, flat medium having high heat conductivity. Base 2 prevents leakage of hot-melt ink 3 to base rear surface 8, and contamination of a thermal head or the like. Base 2 employs a known base. Examples of base 2 are polymeric films such as films of polyethylene, polypropylene, polyethylene terephthalate, polyimide, and the like, or thin sheet-like bases such as condenser paper, laminated paper, coated paper, and the like. In consideration of thermal response during transfer and mechanical strength, base 2 preferably has a thickness of 3 to 15 μm. However, the present invention is not limited to this. A heat-resistant treatment may be performed on rear surface 8 of base 2, which faces hot-melt ink layer 3 and is in contact with the thermal head.

Adhesive layer 15 is provided between base 2 and hot-melt ink layer 3. Layer 15 serves to prevent peeling of hot-melt ink layer 3 from base 2. In addition, adhesive layer 15 improves heat stability of the thermal transfer ink sheet of this invention, and can improve repetitive printing stability at low temperatures. The thickness of the adhesive layer 15 can be set to fall within the range of 0.1 to 5 μm. However, in consideration of heat sensitivity and bonding strength, the thickness of the adhesive layer is preferably set to fall within the range of 0.3 to 2 μm. Examples of the material for adhesive layer 15 include polyethylene, cross-linked polyethylene, chlorinated polyethylene, an ethylene-vinyl acetate copolymer, polyethylene terephthalate, polypropylene, polyisobutylene, polyvinyl chloride, polyvinylidene chloride, polyvinyl acetate, polyvinyl alcohol, polyvinyl acetal, a fluorocarbon polymer, an acrylic resin, polyacrylonitrile, polystyrene, an acetal resin, polyamide, polycarbonate, a cellulose derivatives, a styrene-acrylonitrile copolymer, an acrylonitrile-butadiene-styrene terpolymer, a phenolic resin, a urea resin, an epoxy resin, an unsaturated polyester resin, an acrylic ester resin, an alkyd resin, a melamine resin, a silicone resin, polyurethane, a diallyl phthalate resin, polyphenylene oxide, polyimide, polysulfone, chlorinated rubber, rubber hydrochloride, cyclized rubber, polyisoprene, polybutadiene, a styrene-butadiene copolymer, polychloroprene, nitrile rubber, butyl rubber, acrylic rubber, ethylene-propylene rubber, and the like. These materials can be used singly or in a combination of two or more. Adhesive layer 15 can be formed by coating means such as hot-melt coating, solvent coating and the like.

Hot-melt ink layer 3 formed on adhesive layer 15 is a known hot-melt ink layer, which is constituted by a coloring agent, a wax, a resin, an oil, and the like. If pigments are used, examples for black printing are carbon black, oil black, and the like. In the case of color printing, examples are normal pigments such as benzene yellow, rhodamine lake B, phthalocyanine blue, and the like. Of course, dyes may be used depending on applications. Examples of the wax are paraffin wax, microcrystalline wax, carnauba wax, montan wax, Japan wax, bees wax, low-molecular weight polyethylene wax, synthetic wax, and the like. Examples of the resin are an ethylene-vinyl acetate copolymer, a polyamide resin, a rosin-based derivative, a petroleum resin, an acrylic resin, a polyester resin, and the like. Examples of the oil are a mineral oil, a vegetable oil, and the like.

Hot-melt ink layer 3 is formed as follows. The coloring agent is appropriately mixed and dispersed in the binder to form a hot-melt, solvent- or water-soluble (or emulsion) ink, and the resultant ink is applied on adhesive layer 15 using a gravure process, a roll coator process, a flexographic process, or the like.

A coating amount of hot-melt ink layer 3 for supplying an ink amount necessary for multiple transfer operations can be set to fall within the range of 0.4 to 25 $g/m^2$ from the viewpoint of practical energy sensitivity although it depends on the necessary number of repetitions. When an ink sheet is repetitively used three times or more and a high-resolution, high-density image is expected, a coating amount preferably falls within the range of 2 to 15 $g/m^2$.

Ink holding porous membrane layer 6 (or 6B) in which ink 5 (or 5B) is filled in porous membrane 4 (or 4B) is stacked on hot-melt ink layer 3. The thickness of ink holding porous membrane layer 6 (or 6B) is preferably decreased to be smaller than that of hot-melt ink layer 3 as much as possible, provided a satisfactory mechanical strength can be maintained. This is because, in order to provide a sufficient mechanical strength, the porosity of porous membrane 4 (or 4B) is limited. As a result, an amount of ink filled in the pores is limited. For this reason, In order to fill a larger amount of hot-melt ink in porous membrane 4 (or 4B), ink holding porous membrane layer 6 (or 6B) having a larger thickness is necessary, and this is disadvantageous in terms of thermal sensitivity. Thus, high-speed recording is difficult to achieve. In addition, unsmooth travelling due to a thick film, a decrease in recording capacity due to a decrease in recording length when the sheet is wound around a ribbon core, and the like are caused.

In order to improve sensitivity, as described above, hot-melt ink 5 (or 5B) is held in thin porous membrane 4 (or 4B) having a minimum thickness, and an amount of ink necessary for multiple transfer operations can be refilled from underlying hot-melt ink layer 3. In this case, the thickness of porous membrane ink holding layer 6 (or 6B) falls within the range of 0.05 pl to 5 μm to provide the effect of the present invention. If the thickness of ink holding porous membrane layer 6 (or 6B) is smaller than 0.05 μm or less, the porous film is broken and the reusable ink sheet cannot provide its function due to insufficient mechanical strength. Meanwhile, if the thickness is larger than 5 μm, thermal sensitivity is degraded. Therefore, it is difficult to obtain a high-quality, high-density image. In addition, after the ink sheet is subjected to printing by a thermal head, an amount of ink left in porous membrane 4 (or 4B) is large, resulting in poor utilization efficiency of ink.

The range of diameters of independent holes (or continuous holes) of porous membrane 4 (or 4B) constituting ink holding porous membrane layer 6 (or 6B) before being filled with ink, depends on a minimum particle size of hot-melt inks 3 and 5 (or 5B) and a size of unit recording pixel of a thermal transfer printer. A minimum diameter of a hole is preferably 0.5 μm or more and a maximum diameter is preferable 160 μm or less assuming that 6 heating elements in a thermal head printer are arranged per mm, although they depend on a dispersion state of hot-melt inks 3 and 5 (or 5B). A porosity when no ink is filled in porous membrane 4 (or 4B) is set to fall within the range of 30 to 97% in consideration of the mechanical strength of the porous membrane layer, a pixel density of the heating body, and thermal sensitivity of the thermal transfer ink sheet.

The volume filling rate of hot-melt ink 5 (or 5B) held in the pores of porous membrane layer 4 (or 4B) is limited. When no hot-melt ink 5 (or 5B) is held in the pores of porous membrane 4 (or 4B) at all, i.e., in a state wherein a porous body is simply stacked on hot-melt ink layer 3 (the volume filling rate of ink is 0%), since materials having different contraction stresses are simply stacked, the multilayered structure is easily curled. Since a bonding strength between hot-melt ink layer 3 and porous membrane 4 (or 4B) is insufficient, the porous membrane layer is easily broken during printing, and such a reusable thermal transfer ink sheet cannot be put into practical use. When hot-melt ink 5 (or 5B) is completely filled in pores of porous membrane 4 (or 4B) (the volume filling rate of ink is 100%), since hot-melt ink does not require energy to be impregnated in pores in the porous film, thermal response is improved, and a bonding strength between adjacent ink layers, e.g., hot-melt ink layer 3 and porous membrane 4 (or 4B) is improved. Therefore, a mechanical strength high enough to withstand a large number of repetitions can be obtained. In addition, a problem of unsmooth travelling due to curling can be eliminated. The volume filling ratio of hot-melt ink 5 (or 5B) to the pores of porous membrane 4 (or 4B) is preferably increased as much as possible. The practical volume filling ratio (with respect to the pore volume of the membrane 4) is set to fall within the range of 3 to 100 %.

A polymer used for porous membrane 4 (or 4B) as a component of porous membrane ink holding layer 6 (or 6B) preferably has a softening temperature or melting temperature of 100° C. or higher. Examples of the polymer include polyvinyl acetate, a vinyl chloride-vinyl acetate copolymer, polyvinyl butyral, an acrylic resin, polyamide, an acrylonitrile-vinyl chloride copolymer, a cellulose derivatives, polyester, polyurethane, synthetic rubber, and mixtures thereof. In order to improve printing or coating properties and to improve apparent heat resistance, the porous membrane layer may have, as a constituting component, pigment particles such as calcium carbonate, titanium oxide, silicon oxide, zinc oxide, carbon, or the like. In addition, an appropriate solvent, nonsolvent, or poor solvent may be selected to use a composition in a slurry state.

A reusable thermal transfer ink sheet of the present invention is prepared as follows. The polymeric slurry is coated on hot-melt ink layer 3, and thereafter, a microporous structure having pores is obtained by utilizing a difference in evaporation rates of good and poor solvents (or non-solvents). Then, the resultant structure is subjected to a heat treatment, so that hot-melt ink 5 (or 5B) is filled in porous membrane 4 (or 4B).

A thermal transfer recording method of the present invention will be described with reference to the drawings using a thermal transfer ink sheet having a multilayered (at least four-layered) structure obtained as described above.

Figure 3:
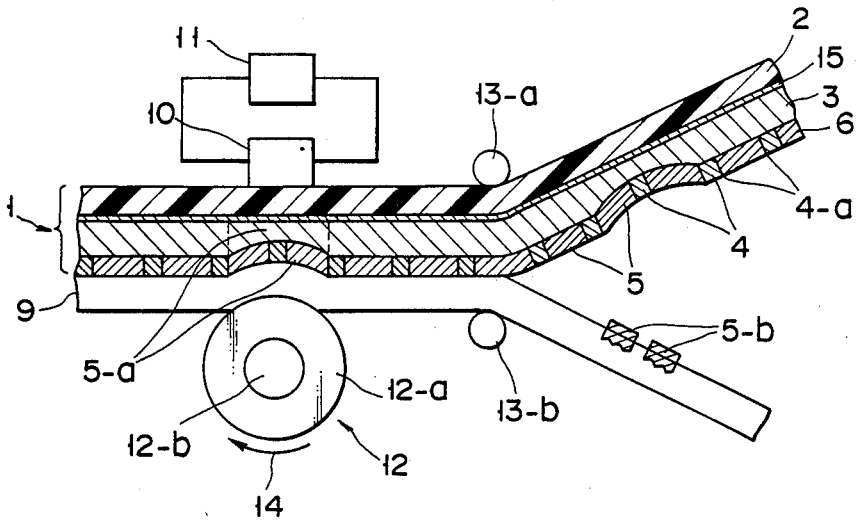
FIG. 3 is a sectional view for explaining a recording method using the thermal transfer ink sheet.

Referring to FIG. 3, recording sheet 9 is placed to face thermal transfer ink sheet 1 described above. Thereafter, sheets 9 and 1 are inserted between thermal head 10 and compression roller 12 having rubbery elastic body 12-a on at least its surface, and are kept in a compressed state. Compression roller 12 may be separately constituted by rubbery elastic body 12-a and supporting body 12-b or may be an integrally molded body. Thereafter, a signal generated by power supply unit 11 is supplied to thermal head 10 through an electrical circuit, and body 10 is heated. Then, hot-melt ink 5-a located at a contact position is melted by heat conducted through base 2, is deformed by a high compression force, is pushed out through micropores 4-a of porous membrane 4, and reaches recording sheet 9. Thereafter, thermal transfer ink sheet 1 and recording sheet 9 are peeled at convey roller units 13-a and 13-b, thus obtaining transfer image 5-b. In the above description, when compression roller 12 is rotated in a direction of arrow 14 while thermal head 10 is heated, an image can be continuously transferred.

Figure 4:
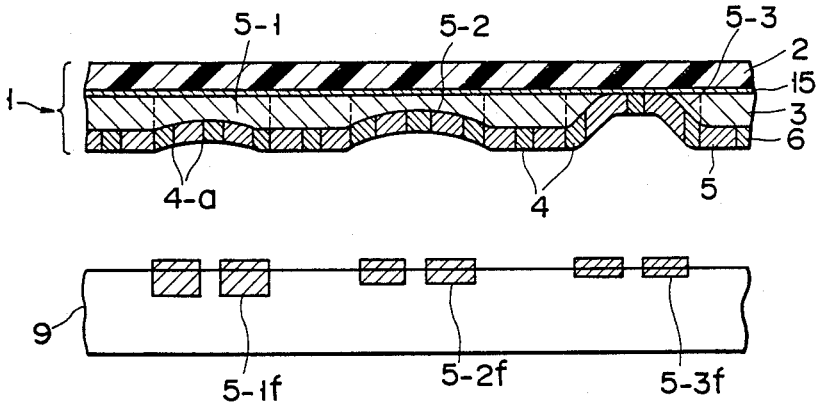
FIG. 4 is a sectional view for explaining the recording principle when the thermal transfer ink sheet is used.

The principle of multiple use will be described with reference to FIG. 4. The thermal head and the compression roller are omitted from FIG. 4, but the positional relationship therebetween complies with FIG. 3. In FIG. 4, 5-1, 5-2, and 5-3 illustrate transferred states obtained when an identical position of a thermal transfer ink sheet is subjected to printing with identical energy and the number of repetitions is increased in the order named.

Portion 5-1 of hot-melt ink layer 3 and hot-melt ink 5 filled in porous membrane 4 which are heated by the thermal head is uniformly melted, and begins to flow through holes 4a while being compressed. Since a sufficient amount of hot-melt ink is held on base 2, transfer amount 5-1t onto recording sheet 9 is large, and high reflection density can be obtained.

In portion 5-2, since an amount of hot-melt ink held on base 2 is smaller than that of portion 5-1, amount 5-2t of ink transferred onto recording sheet 9 is decreased as the number of repetitions is increased. Thus, the reflection density tends to be decreased.

In portion 5-3 subjected to a further increased number of repetitions, ink 5 filled in the porous membrane ink holding layer is also transferred onto recording sheet 9, and almost all ink in portion 5-3 of ink sheet 1 is consumed. Thus, it can be demonstrated that ink can be efficiently used without waste.

Figure 5:
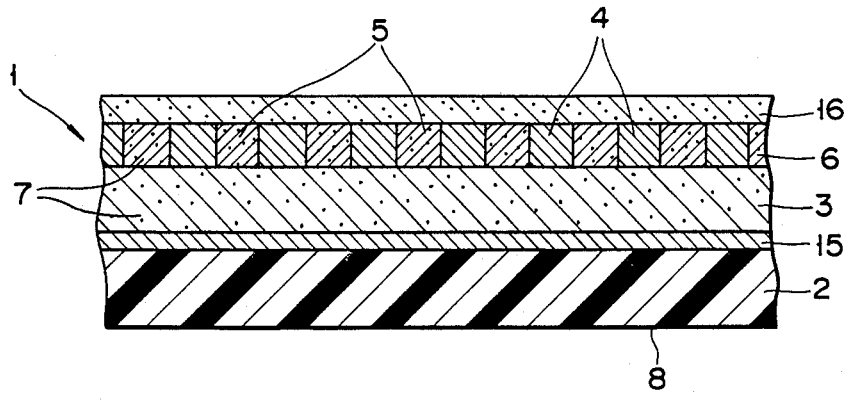
FIGS. 5 and 6 are sectional views of thermal transfer ink sheets according to another embodiment of the present invention.
Figure 6:
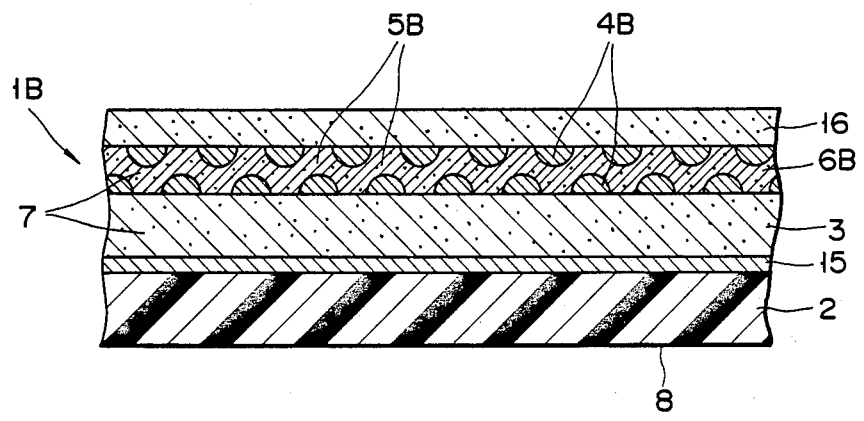

An embodiment shown in FIGS. 5 and 6 is a modification of the embodiment shown in FIGS. 1 and 2. If hot-melt ink layer 3 in FIGS. 1 and 2 is called a first hot-melt ink layer, second hot-melt ink layer 16 is turner stacked on the upper surface of ink holding porous membrane layer 6 (or 6B) in the embodiment shown in FIGS. 5 and 6. Other structures are the same as those in the embodiment shown in FIGS. 1 and 2. Therefore, the same reference numerals in this embodiment denote the same parts as in the embodiment shown in FIGS. 1 and 2, and a detailed description thereof will be omitted.

Second hot-melt ink layer 16 can be formed of a material which is the same as or different from that of first hot-melt ink layer 3.

Second hot-melt ink layer 16 stacked on ink holding porous membrane layer 6 (or 6B) has the same composition as that of the first hot-melt ink layer, and its coating amount can be set to fall within the range of 0.4 to 15 $g/m^2$. In this case, from the viewpoint of energy sensitivity, the coating amount preferably falls within the range of 0.4 to 8 $g/m^2$. The advantage of stacking second hot-melt ink layer 16 is that a print having a quality equivalent to or higher than that of a conventional disposable one-time ribbon can be obtained in at least a first printing operation. Second hot-melt ink layer 16 does not require energy to pass through porous membrane 4

(or 4B) unlike first hot-melt ink layer 3. Therefore, as compared to an ink sheet in which ink is all filled thereinto (Japanese Patent Disclosure No. 55-105579), a high-sensitivity, high-resolution image can be obtained.

A multiple reusable thermal transfer ink sheet shown in FIGS. 5 and 6 is prepared as follows. That is, the polymeric slurry is coated on first hot-melt ink layer 3, and thereafter, a microporous structure having through pores is obtained by utilizing a difference in evaporation rates of good and poor solvents (or non-solvent). Then, the resultant structure is subjected to a heat treatment to be filled with the hot-melt ink. Then, second hot-melt ink layer 16 is coated. The resultant structure is subjected to a heat treatment, and hot-melt ink 5 (or 5B) is filled in porous membrane 4 (or 4B).

Examples

The present invention will be described below by way of its examples and comparative examples. The present invention is not limited to these examples, and various changes and modifications may be made within the spirit and scope of the invention.

(Example 1)

An adhesive layer coating solution represented by formulation a was solvent-coated on a 6.0-μm thick polyethylene terephthalate film using a gravure roll coated, thus forming an adhesive layer having a dried film thickness of 1.0 μm.

| (Formulation A) | |
|---|---|
| Ethylene-vinyl acetate copolymer (available from Diabond Kogyo-sha) | 5 parts by weight |
| Toluene | 95 parts by weight |

Furthermore, a hot-melt ink material composition containing paraffin wax represented by formulation B as a major component was kneaded under heating to prepare hot-melt ink in a 3-roll mill in which the roll surface temperature was heated to 110° C. The resultant ink was coated on the adhesive layer by flexographic printing to form an 8-μm thick hot-melt ink layer.

| (Formulation B) | |
|---|---|
| Paraffin wax (melting point 67° C. available from NIPPON SEIRO CO., LTD) | 60 parts by weight |
| Carnauba wax (melting point 80° C. available from NIPPON SEIRO CO., LTD) | 10 parts by weight |
| Wax oxide (melting point 75° C. available from NIPPON SEIRO CO., LTD) | 10 parts by weight |
| Ethylene-vinyl acetate copolymer (available from Nippon Unika-sha) | 5 parts by weight |
| Carbon black (available from NIPPON KAYAKU CO., LTD) | 15 parts by weight |

A porous membrane coating solution was prepared by a material composition represented by formulation C. The resultant solution was coated on the hot-melt ink layer using a gravure roll coater to form a porous membrane protection layer having a thickness of 0.4 μm. Then, a heat treatment was performed, and the hot-melt ink represented by formulation B was filled in pores of the porous membrane at a rate of about 100% to form an ink holding porous membrane layer, thereby obtaining a thermal transfer ink sheet of the present invention.

| (Formulation C) | |
|---|---|
| Nitrocellulose (available from DAICEL CHEMICAL INDUSTRIES, LTD.) | 10 parts by weight |
| Methyl ethyl ketone | 80 parts by weight |
| Water | 10 parts by weight |

As a result of electron microscopic observation of the resultant sheet, pore diameters of the porous film before being filled with ink fell within the range of 5 to 8 μm and were substantially uniformly distributed. The final structure of this invention wherein the ink holding porous membrane layer filled with the ink was stacked on the hot-melt ink was confirmed.

The thermal transfer ink sheet was subjected to repetitive printing at an identical portion using a commercially available portable wordprocessor, and was evaluated. As the wordprocessor, Bungo mini35E available from NEC CORP. was used, a printing speed was set in a standard mode, and a printing voltage was set in an intermediate mode. Printing was performed in solid black on thermal recording sheets available from Honshu Paper Co., Ltd., and a reflection density was measured by SAKURA densitometer PDA-65 (available from Konishiroku Photo Industry Co., Ltd.). As a result, as shown in Table 1, no peeling of the hot-melt ink from the adhesive layer was observed at all, and printing with a small decrease in density could be performed 6 times.

(Example 2)

An adhesive layer coating solution represented by formulation D was solvent-coated on a 6.0-μm thick polyethylene terephthalate film using a gravure roll coater, thus forming an adhesive layer having a dried film thickness of 1.0 μm.

| (Formulation D) | |
|---|---|
| Urethane resin (available from DAINIPPON INK & CHEMICALS, INC.) | 5 parts by weight |
| Toluene | 95 parts by weight |

Furthermore, a hot-melt ink material composition represented by formulation E was heated and kneaded following the same procedures as in Example 1, and the resultant ink was coated on the adhesive layer by flexographic printing, thus forming an 8-μm hot-melt ink layer.

| (Formulation E) | |
|---|---|
| Ester wax (melting point 70° C. available from NIPPON SEIRO CO., LTD.) | 70 parts by weight |
| Paraffin wax (melting point 67° C. available from NIPPON SEIRO CO., LTD.) | 10 parts by weight |
| Carbon black (available from NIPPON KAYAKU CO., LTD) | 20 parts by weight |

A porous membrane protection layer solution for coating was prepared using a material composition represented by formulation F. The resultant solution was coated on the hot-melt ink layer following the same procedures as in Example 1, thus forming a 0.4-μm thick porous film protection film. A heat treatment was then performed to form an ink holding porous membrane layer (ink volume filling rate to pores was about 100%), thereby obtaining a thermal transfer ink sheet of the present invention.

| (Formulation F) | |
|---|---|
| Polyvinyl butyral (available from Sekisui Chemical Co., Ltd.) | 10 parts by weight |
| Methyl ethyl ketone | 70 parts by weight |
| Ethanol | 10 parts by weight |
| Water | 10 parts by weight |

Following the same procedures as in Example 1, the resultant ink sheet was subjected to repetitive printing at a standard mode printing speed and an intermediate voltage. As a result, no peeling of the hot-melt ink from the adhesive layer was observed, and printing with a small decrease in density could be performed 6 times, as shown in Table 1.

Comparative

(Comparative Example 1)

A hot-melt ink layer represented by formulation E was formed on a 6-μm thick polyethylene terephthalate film serving as a base following the same procedures as in Example 2, except that no adhesive layer was formed. Then, a porous membrane protection layer solution for coating represented by formulation F was coated on the hot-melt ink layer to form a 0.4-μm thick porous membrane ink holding layer, thereby obtaining a comparative sample. The sample was subjected to repetitive printing operation at a standard mode speed and an intermediate voltage as in Example 1. As a result, during the 5th printing operation and thereafter, the hot-melt ink layer was peeled from the base film, and an abrupt decrease in density was observed. From the results of Example 2 and Comparative Example 1, in order to obtain a thermal transfer ink sheet having a stabler repetition life, the adhesive layer is preferably provided between the base and the hot-melt ink layer as in Example 2 (see Table 1).

(Comparative Example 2)

An adhesive layer coating solution represented by formulation A was coated on a 6-μm thick polyethylene terephthalate membrane serving as a base following the same procedures as in Example 1, except that no ink holding porous membrane layer was provided. Furthermore, a hot-melt ink layer represented by formulation E was formed to obtain a comparative sample having a three-layered structure consisting of the base, the adhesive layer, and the hot-melt ink layer. The sample was subjected to repetitive printing operation at a standard mode speed and an intermediate voltage as in Example 1. As a result, the adhesive layer was peeled from the hot-melt ink layer, and the sheet was a so-called one-time product in which all ink was transferred by the first printing operation. Therefore, it was found that if only an adhesive layer was provided between the base and the hot-melt ink layer, an amount of ink transferred to a recording sheet could not be controlled.

TABLE 1

| | | NUMBER OF TIMES OF PRINTING (AND PRINTING DENSITY | | | | | | |
|---|---|---|---|---|---|---|---|---|
| | | Optical Reflection Density | | | | | | |
| Example/ Comparative Example | Structure | 1st (Printing Operation) | 2nd | 3rd | 4th | 5th | 6th | Remarks |
| Example 1 | base/ adhesive layer/ hot-melt ink layer/ porous membrane ink holding layer | 1.2 | 1.2 | 1.1 | 1.1 | 1.0 | 1.0 | present invention |
| Example 2 | base/ adhesive layer/ hot-melt ink layer/ porous membrane ink holding layer | 1.1 | 1.1 | 1.0 | 1.0 | 1.0 | 0.9 | present invention |
| Comparative Example 1 | base/hot-melt ink layer/porous membrane ink holding layer | 1.2 | 1.2 | 1.1 | 1.3 | 0.3 | 0.1 | prior art |
| Comparative Example 2 | base/adhesive layer/ hot-melt ink layer | 1.7 | 0.2 | 0.1 | 0.1 | 0.1 | 0.1 | prior art |

(Example 3)

Following the same procedures as in Example 1, a 0.4-μm thick porous membrane protection layer was formed on a hot-melt ink layer. Thereafter, hot-melt ink represented by formulation B of Example 1 was coated on the porous membrane protection membrane to form a 3-μm thick second hot-melt ink layer. A heat treatment was then performed, so that hot-melt ink represented by formulation B was filled in pores of the porous membrane at a rate of about 100% to firmly bond the first and second hot-melt ink layers, thereby obtaining a thermal transfer ink sheet of the present invention.

The thermal transfer ink sheet was subjected to repetitive printing at an identical portion using a commercially available portable wordprocessor, and was evaluated. As the wordprocessor, Bungo mini3E available from NEC CORP. was used, a printing speed was set in a high-quality mode, and a printing voltage was set in an intermediate mode. Printing was performed in on normal sheets (Bekk smoothness, 30 sec) available from Xerox Corp., and a reflection density was measured by SAKURA densitometer PDA-65 (available from Konishiroku Photo Industry Co., Ltd.). As a result, as shown in Tables 2 and 3, no peeling of the hot-melt ink from the adhesive layer was observed at all, and printing with a small decrease in density could be performed 6 times.

(Example 4)

Following the same procedures as in Example 3, a 0.4-μm thick porous membrane protection layer was formed on a hot-melt ink layer.

Furthermore, hot-melt ink represented by formulation E in Example 3 was coated to have a thickness of 3 μm in the same manner as in Example 1,and a heat treatment was performed (a volume filling rate to pores of the porous membrane was about 100%), thereby obtaining a thermal transfer ink sheet of the present invention.

The ink sheet was subjected to repetitive printing operation in a high-quality speed mode and at an intermediate voltage. As a result, as shown in Tables 2 and 3, no peeling of membrane was observed at all, and printing with a small decrease in density could be performed 6 times.

COMPARATIVE EXAMPLES (Comparative Example 3)

An adhesive layer coating solution represented by formulation A was coated on a 6-μm thick polyethylene terephthalate film serving as a base following the same procedures as in Example 3, except that no porous membrane ink holding layer was provided. Furthermore, a 1-μm thick hot-melt ink layer represented by formulation E was formed to obtain a comparative sample having a three-layered structure consisting of the base, the adhesive layer, and the hot-melt ink layer. The sample was subjected to repetitive printing operation at a high-quality speed and an intermediate voltage as in Example 3. As a result, the adhesive layer was peeled from the hot-melt ink layer, and the sheet was a so-called one-time product in which all ink was transferred by the first printing operation. Therefore, it was found that if only an adhesive layer was provided between the base and the hot-melt ink layer, an amount on ink transferred to a recording sheet could not be controlled (see Tables 2 & 3).

TABLE 2

THERMAL TRANSFER INK SHEET STRUCTURE OF EXAMPLES & COMPARATIVE EXAMPLE

| Example/ Comparative Example | Structure | Remarks |
|---|---|---|
| Example 3 | base/adhesive layer/first hot-melt ink layer/porous membrane ink holding layer/second hot-melt ink layer | present invention |
| Example 4 | base/adhesive layer/hot-melt ink layer/porous first ink holding layer/second hot-melt ink layer | present invention |
| Comparative Example 3 | base/adhesive layer/hot-melt ink layer | prior art |

TABLE 3

REPETITION CHARACTERISTICS OF THERMAL TRANSFER INK SHEET

| Example Comparative Example | Optical Reflection Density 1st (Printing) | 2nd | 3rd | 4th | 5th | 6th |
|---|---|---|---|---|---|---|
| Example 3 | 1.3 | 1.3 | 1.1 | 1.0 | 0.9 | 0.9 |
| Example 4 | 1.4 | 1.3 | 1.0 | 0.9 | 0.9 | 0.9 |
| Comparative Example 3 | 1.7 | 0.3 | 0.1 | 0.1 | 0.1 | 0.1 |

*Printed on Xerox paper (Example 5)

Thermal transfer ink sheets prepared in Example 1 were stored for a long period of time at different storage condition between −30° C. and 60° C. as shown in Table 4. Then, a printing operation was performed for these thermal transfer ink sheets at different printing temperatures within the range of 5° C. and 40° C., as shown in Table 4. The results are summarized in Table 4.

(Comparative Example 4)

For the purpose of comparison, thermal transfer ink sheets prepared in Comparative Example 1 were stored for a long period of time under the same conditions as in Example 5, and a printing operation was performed under the same printing temperature conditions as in Example 5. The results are also summarized in Table 4.

TABLE 4

| Preservation Condition | Example 5 (with adhesive layer) Printing Condition 5° C. | 10° C. | 20° C. | 40° C. | Comparative Example 4 (without adhesive layer) Printing Condition 5° C. | 10° C. | 20° C. | 40° C. |
|---|---|---|---|---|---|---|---|---|
| −30° C. | o | o | o | o | x | x | o | o |
| 20° C. | o | o | o | o | x | x | o | o |
| 45° C. | Δ | o | o | o | x | x | o | o |
| 60° C. | Δ | o | o | o | x | x | Δ | Δ |

o . . . effective several times
x . . . one-time sheet (ink is peeled from base after first printing)
Δ . . . level between o and x A thermal transfer ink sheet according to the present invention has a structure as described above. Therefore, as compared to a conventional one-time type transfer sheet, a number of times of use are possible. Since the ink sheet of the present invention has an improved mechanical strength as compared to a conventional reusable transfer sheet, a stable repetition life can be obtained. Since the ink sheet of the present invention has a thin structure, a high-quality, high-resolution image can be obtained upon application of low energy. Moreover, since printing can be performed for an inexpensive recording sheet with low smoothness, great reduction in running cost can be expected.

What is claimed is:

1. A reusable thermal transfer ink sheet comprising a sheet material base, a hot-melt ink layer stacked on said base through an adhesive layer, and an ink holding porous membrane layer which is stacked on said ink layer and is filled with hot-melt ink.

2. A thermal transfer ink sheet according to claim 1, wherein said adhesive layer has a thickness ranging from 0.05 to 5.0 μm.

3. A thermal transfer ink sheet according to claim 2, wherein said hot-melt ink layer is coated on said adhesive layer at an amount of from 0.4 to 25 g/m$^2$.

4. A thermal transfer ink sheet according to claim 3, wherein said ink holding porous membrane layer has an unfilled porosity to 30 to 97%.

5. A thermal transfer ink sheet according to claim 4, wherein said ink holding porous membrane layer is filled therein with a hot-melt ink at a filling ratio of 3 to 100%.

6. A thermal transfer ink sheet according to claim 5, wherein said ink holding porous membrane layer is filled therein with a hot-melt ink at a filling ratio of about 100%.

7. A thermal transfer ink sheet according to claim 1, wherein said adhesive layer is made of a synthetic resin.

8. A thermal transfer ink sheet according to claim 1, wherein said hot-melt ink layer comprises a coloring agent and a binder.

9. A thermal transfer ink sheet according to claim 1, wherein said hot-melt ink layer is coated on said adhesive layer at an amount of from 0.4 to 25 g/m$^2$.

10. A thermal transfer ink sheet according to claim 1, wherein said ink holding porous membrane 0.05 to 5.0 μm.

11. A thermal transfer ink sheet according to claim 1, wherein said ink holding porous membrane layer has a porosity (before being filled with ink) of 30 to 97%.

12. A thermal transfer ink sheet according to claim 1, wherein said ink holding porous membrane layer is filled therein with a hot-melt ink at a filling ratio of 3 to 100% by volume.

13. A thermal transfer ink sheet comprising a sheet material base, a first hot-melt ink layer stacked on said base through an adhesive layer, an ink holding porous membrane layer which is stacked on said ink layer and is filled with hot-melt ink, and a second hot-melt ink layer stacked on said ink holding porous membrane layer.

* * * * *